US006581558B1

(12) United States Patent
Ott

(10) Patent No.: US 6,581,558 B1
(45) Date of Patent: Jun. 24, 2003

(54) INTERNAL COMBUSTION ENGINE TAPERED PUSH ROD ASSEMBLIES

(76) Inventor: Vern D. Ott, 1839 Rt. 746 S., Cardington, OH (US) 43315

( * ) Notice: Subject to any disclaimer, the term of this patent is extended or adjusted under 35 U.S.C. 154(b) by 0 days.

(21) Appl. No.: 10/128,170

(22) Filed: Apr. 23, 2002

(51) Int. Cl.[7] ..... F01L 1/14

(52) U.S. Cl. ..... 123/90.61; 123/90.48; 74/587

(58) Field of Search ..... 123/90.61, 90.35, 123/90.48; 74/587; 92/187

(56) References Cited

U.S. PATENT DOCUMENTS 1,767,882 A * 6/1930 Hammond ..... 74/587

5,069,173 A * 12/1991 Mallas ..... 123/90.61

* cited by examiner

*Primary Examiner*—Thomas Denion
*Assistant Examiner*—Kyle Riddle
(74) *Attorney, Agent, or Firm*—Thomas S. Baker, Jr.

(57) ABSTRACT

An internal combustion engine tapered push rod assembly construction is disclosed, as well as a novel method of partially making the assembly elongated body section component from tubular push rod feedstock by removing excess exterior feedstock to form the body section exterior taper rather than by known conventional radial compression of feedstock exterior material that otherwise results in an unwanted feedstock reduced internal diameter, and an unwanted increased body section wall thickness configuration.

1 Claim, 1 Drawing Sheet

INTERNAL COMBUSTION ENGINE TAPERED PUSH ROD ASSEMBLIES

CROSS-REFERENCES

None.

FIELD OF THE INVENTION

This invention relates generally to internal combustion engines, and particularly pertains to a method of making internal combustion engine tapered push rods and to the improved internal combustion engine tapered push rods resulting from the practice of the method aspect of the invention.

BACKGROUND OF THE INVENTION

In the United States most high-performance internal combustion engines having a capability of providing maximum continuous high torque output power at very high revolution per minute operating speeds, e.g. 7,300 to 7,500 revolutions per minute, utilize solid valve push rod components having a uniform external diameter. Any unnecessary weight included in individual valve push rod components or in the engine intake and exhaust valve trains undesirably detracts form engine operating responsiveness at such high revolution per minute operating speeds.

I have discovered an internal combustion engine push rod assembly construction that may be used to eliminate unnecessary weight from engine valve trains and accordingly improve engine responsiveness at relatively high operating speeds.

Other objects of the present invention will become apparent from consideration of the following detailed descriptions, drawings, and claims.

SUMMARY OF THE INVENTION

From a manufacturing procedure standpoint the present invention primarily involves the novel step of machining or otherwise removing excess metal from tapering exterior regions of engine push rod tubular feedstock to thereby form a push rod assembly tapered body section rather than radially compressing the otherwise excess feedstock metal into a reduced-diameter body section of increased wall thickness as taught by the prior art.

From a product configuration standpoint, the internal combustion engine push rod assembly of the present invention is comprised of a uniformly tapered and elongated body section having longitudinally varying wall thickness, a conventional rod length adjustment device secured to the body section at its end with greater wall thickness, a push rod foot section joined to the free end of the length adjustment device, and a secured-in-place rod end bearing member at each free end of the assembly. The invention assembly is additionally distinguished by the inclusion of an internal, continuous uniform-diameter, lubricant passageway extending throughout the length of the internal combustion engine push rod assembly.

DETAILED DESCRIPTION

Figure 1:
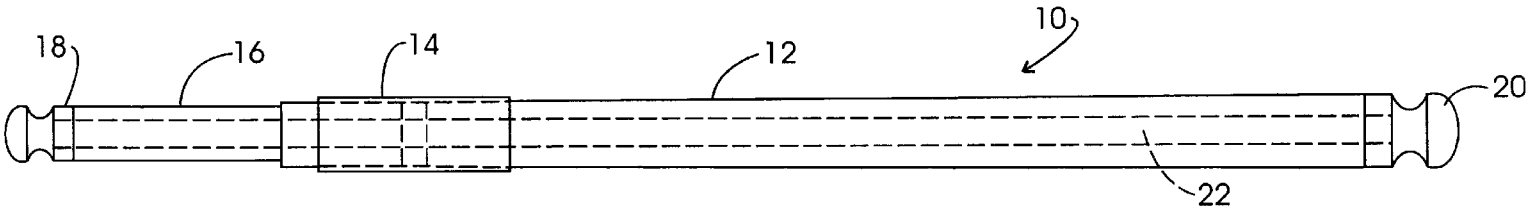
FIG. 1 is a schematic elevation view of a preferred embodiment of the internal combustion engine push rod assembly of the present invention.
Figure 2:
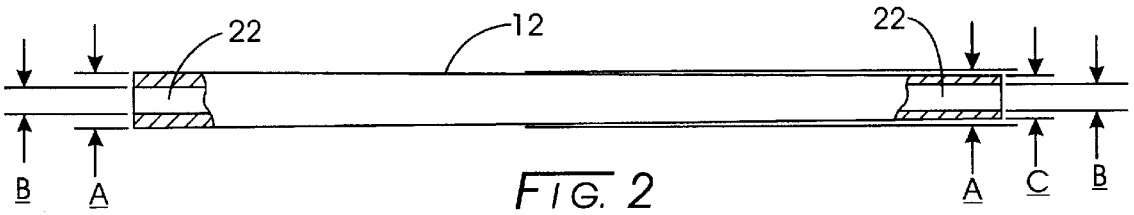
FIG. 2 is a partially sectioned elevation view of the elongated body section of the FIG. 1 assembly.

FIGS. 1 and 2 schematically illustrate a preferred embodiment 10 of the internal combustion engine push rod assembly of the present invention. Assembly 10 is essentially comprised of an elongated rod body section 12, a conventional threaded rod length adjuster section 14 joined to the interior end of rod body section 12, a rod foot section 16 joined to rod length adjuster section 14, and rod end bearing members 18 and 20. Rod end bearing members 18 and 20 are each preferably made of a heat treatable steel material, are each respectively pressed into the free ends of rod body section 12 and rod foot section 16, and each respectively engages a conventional valve lifter component and a conventional co-operating rocker arm component of a conventional internal combustion engine. As illustrated in FIG. 1 of U.S. Pat. No 3,272,190 issued Sep. 13, 1966 to Di Matteo, Sr. et al., for instance, in a conventional internal combustion engine the valve lifter component is reciprocated or driven by the engine cam shaft and in turn drives the engine valve rocker arm component through the co-operating engine push rod component. (The conventional engine rocker arm component in turn drives a respective one of the engine intake or exhaust valve components).

As illustrated in FIG. 2, rod body section 12 has an exterior interior diameter which constantly tapers from its initial diameter A at its end connected to rod length adjuster section to the reduced exterior diameter C at its end bearing member 20, but has an internal lubricant passageway 22 that is of constant internal diameter B throughout its length. It is such exterior and diameter differences that in-part distinguish the instant invention from the prior art.

Figure 3:
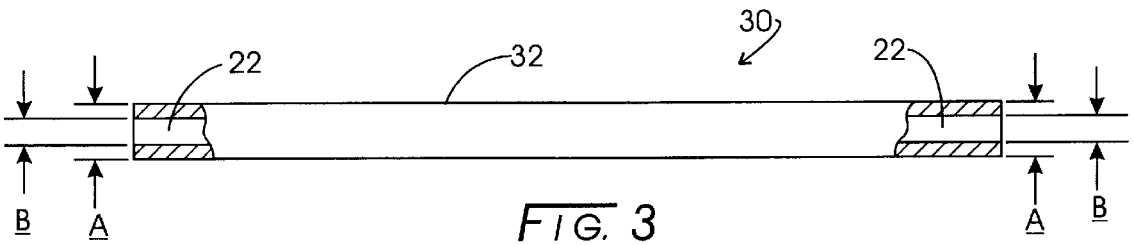
FIG. 3 PRIOR ART
FIG. 3 schematically illustrates the body section of a conventional prior art internal combustion assembly push rod component.

FIG. 3 schematically illustrates the principal diametrical characteristics of the prior art internal combustion engine push rod body section 30 most commonly utilized heretofore in the United States. Rod body section 30 has a constant exterior diameter A and a constant interior lubricant passageway diameter of B throughout its entire length.

Figure 4:
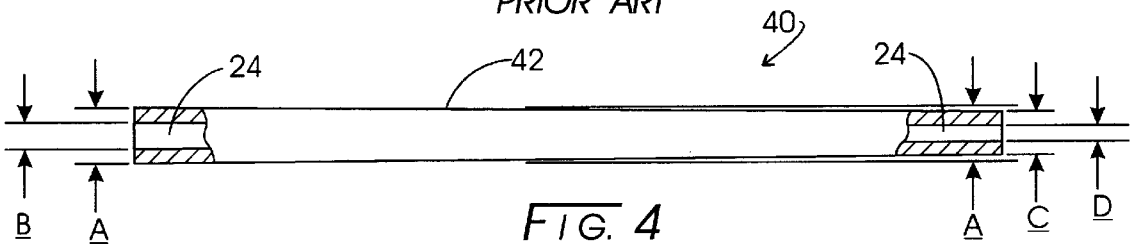
FIG. 4 PRIOR ART
FIG. 4 schematically illustrates the body section component of a prior art internal combustion engine push rod assembly having a conventionally-formed push rod assembly tapered body section component.

FIG. 4, on the other hand, schematically illustrates the principal diametrical characteristics of another known prior art tubular push rod body section 40 that is exteriorly tapered in the manner of the rod body section 12 of FIGS. 1 and 2, but unlike rod body section 12, also has its internal passageway 24 tapered but from a diameter B at its end utilized nearest the engine crankshaft-driven valve lifter to a reduced internal diameter D at the push rod intended rocker arm end.

I claim, as my invention:

1. An internal combustion engine push rod assembly comprising:

a uniformly tapered and elongated rod body section having a longitudinally varying wall thickness;

a conventional rod length adjuster section secured to said rod body section at the rod body section end with greater wall thickness;

a rod foot section joined to the end of said rod length adjuster section, a secured-in-place rod end bearing member at each end of the assembly; and an internal, continuous, uniform-diameter lubricant passageway extending throughout the length of said internal combustion engine push rod assembly elongated body section, rod length adjuster section, and rod foot section components.

* * * * *